United States Patent [19]

Hasegawa et al.

[11] Patent Number: 4,570,599

[45] **Date of Patent: * Feb. 18, 1986**

[54] AIR-FUEL RATIO FEEDBACK CONTROL SYSTEM FOR INTERNAL COMBUSTION ENGINES, CAPABLE OF ACHIEVING PROPER AIR-FUEL RATIOS FROM THE START OF THE ENGINE

[75] Inventors: Shumpei Hasegawa, Niiza; Noriyuki Kishi, Itabashi, both of Japan

[73] Assignee: Honda Giken Kogyo K.K., Tokyo, Japan

[ * ] Notice: The portion of the term of this patent subsequent to May 1, 2001 has been disclaimed.

[21] Appl. No.: 715,755

[22] Filed: Mar. 25, 1985

Related U.S. Application Data

[63] Continuation of Ser. No. 476,323, Mar. 17, 1983, abandoned.

[30] Foreign Application Priority Data

Mar. 19, 1982 [JP] Japan ..... 57-44087

[51] Int. Cl.[4] ..... F02D 41/14

[52] U.S. Cl. ..... 123/489; 123/479

[58] Field of Search ..... 123/489, 440, 479, 480

[56] References Cited

U.S. PATENT DOCUMENTS

| | | | |
|---|---|---|---|
| 3,681,658 | 8/1972 | Naoi et al. | 123/179 R |
| 4,365,299 | 12/1982 | Kondo et al. | 123/489 |
| 4,392,471 | 7/1983 | Miyagi et al. | 123/489 |
| 4,397,279 | 8/1983 | Iida | 123/489 |
| 4,445,482 | 5/1984 | Hasegawa et al. | 123/489 |

*Primary Examiner*—Andrew M. Dolinar

*Attorney, Agent, or Firm*—Arthur L. Lessler

[57] ABSTRACT

An air-fuel ratio feedback control system for use with an internal combustion engine, which is adapted to control the air-fuel ratio of a mixture being supplied to the engine, by the use of a first coefficient variable in response to the output of an exhaust gas concentration sensor arranged in the exhaust system of the engine when the engine is operating in an operating condition other than particular operating conditions, and by the use of a second coefficient which is a mean value of values of the first coefficient obtained during the above operating condition other than the particular operating conditions when the engine is operating in one of the particular operating conditions, for replacing the first coefficient with the second coefficient. Storage means is provided for storing and holding the value of the second coefficient even when the engine is inoperative.

3 Claims, 14 Drawing Figures

FIRST PROGRAM
1
SECOND PROGRAM
2
START CONTROL
3
BASIC CONTROL
4
ASYNCHRONOUS CONTROL
5
TiCRM,TiCRS TABLES
6,7
KNe TABLE
8
TV TABLE
9
BASIC Ti MAP
10
ACC/DEC SUBROUTINE
11
COEFFICIENT CALCULATING TABLES, SUBROUTINES
12
TV TABLE
9
TiA TABLE
13
KTW TABLE
14
TV TABLE
9

| FIG. 5A | FIG. 5B |
|---|---|

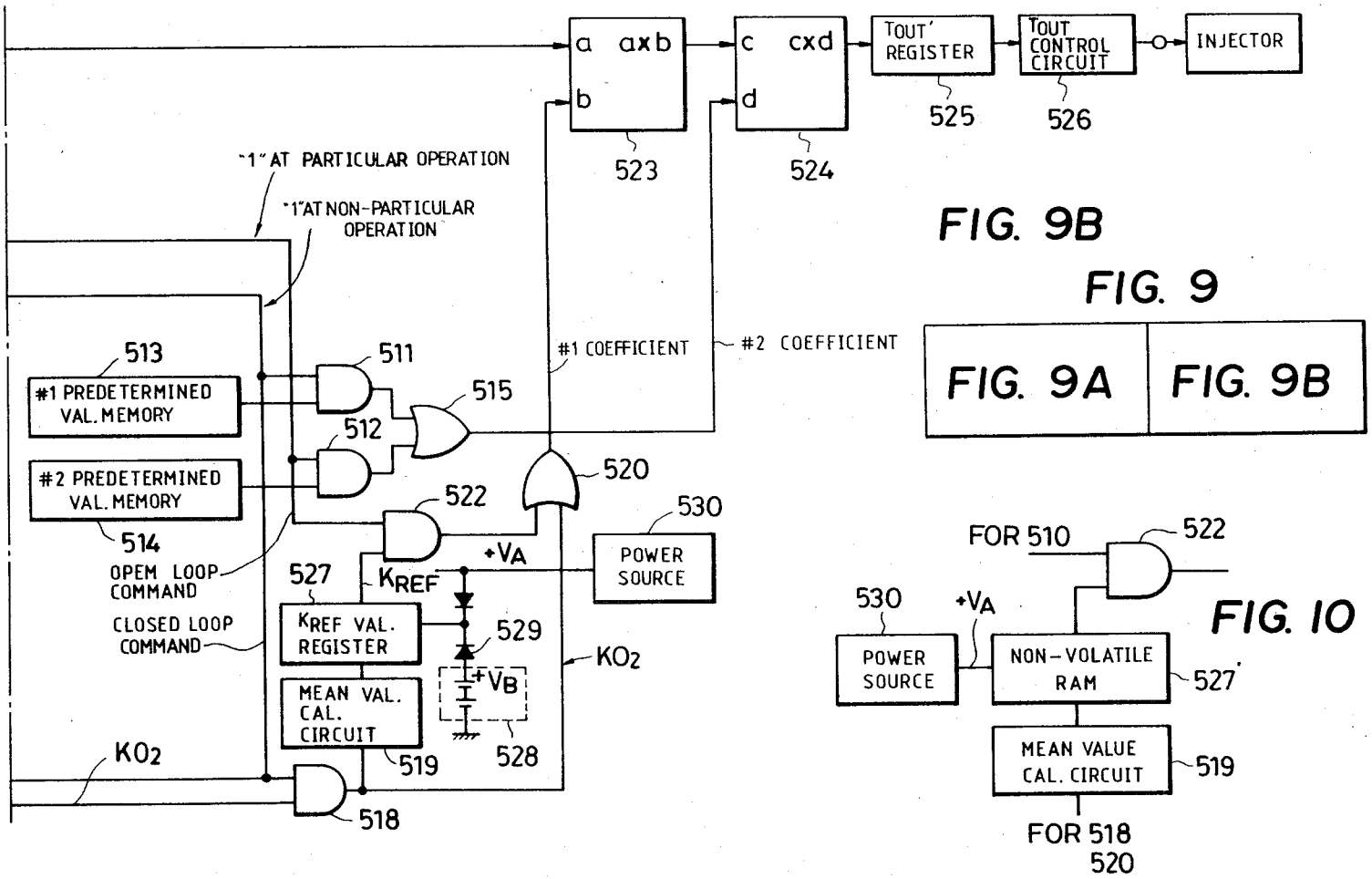
FIG. 9B
FIG. 9
FIG. 9A
FIG. 9B
FIG. 10
INJECTOR
TOUT CONTROL CIRCUIT
526
TOUT' REGISTER
525
cxd
c
d
524
axb
a
b
523
#2 COEFFICIENT
#1 COEFFICIENT
520
POWER SOURCE
530
KO2
+VA
529
+VB
528
515
522
KREF
511
512
527
KREF VAL. REGISTER
MEAN VAL. CAL. CIRCUIT
519
518
"1" AT PARTICULAR OPERATION
"1" AT NON-PARTICULAR OPERATION
513
#1 PREDETERMINED VAL. MEMORY
#2 PREDETERMINED VAL. MEMORY
514
OPEM LOOP COMMAND
CLOSED LOOP COMMAND
KO2
522
FOR 510
+VA
NON-VOLATILE RAM
527'
MEAN VALUE CAL. CIRCUIT
519
FOR 518
520
POWER SOURCE
530

AIR-FUEL RATIO FEEDBACK CONTROL SYSTEM FOR INTERNAL COMBUSTION ENGINES, CAPABLE OF ACHIEVING PROPER AIR-FUEL RATIOS FROM THE START OF THE ENGINE

This application is a continuation of application Ser. No. 06/476,323, filed Mar. 17, 1983 and now abandoned.

BACKGROUND OF THE INVENTION

This invention relates to an air-fuel ratio feedback control system for performing by electronic means feedback control of the air-fuel ratio of an air-fuel mixture being supplied to an internal combustion engine, and more particularly to an air-fuel ratio feedback control system of this kind, which is capable of initiating positive control of the air-fuel ratio to proper values immediately upon starting of the engine.

A fuel supply control system for use with an internal combustion engine, particularly a gasoline engine, has been proposed e.g. by U.S. Ser. No. 348,648, now U.S. Pat. No. 4,445,483, assigned to the assignee of the present application, which is adapted to determine the valve opening period of a fuel quantity metering or injection means for control of the fuel injection quantity, i.e. the air-fuel ratio of an air-fuel mixture being supplied to the engine, by first determining a basic value of the above valve opening period as a function of engine rpm and intake pipe absolute pressure and then adding to and/or multiplying same by constants and/or coefficients being functions of engine rpm, intake pipe absolute pressure, engine temperature, throttle valve opening, exhaust gas ingredient concentration (oxygen concentration), etc., by electronic computing means.

According to this proposed system, feedback control of the air-fuel ratio is carried out when the engine is operating in a normal operating condition, wherein the valve opening period of the fuel injection means is controlled by varying the value of a coefficient in response to the output of an exhaust gas concentration sensor arranged in the exhaust system of the engine, whereas open loop control of the air-fuel ratio is carried out when the engine is operating in particular operating conditions such as idling region, mixture leaning region, wide-open-throttle region, and decelerating region, wherein are applied coefficients which have predetermined values appropriate to respective ones of the particular operating conditions so as to achieve respective optimum air-fuel ratios. Thus, the proposed system can achieve improved characteristics in respect of fuel consumption and driveability.

It is thus desirable that the predetermined air-fuel ratios corresponding to the respective particular operating conditions can be attained without fail by means of open loop control. However, as a matter of fact, the actual air-fuel ratio can sometimes have a value different from a desired predetermined value due to variations in the performance of various sensors for detecting the operating conditions of the engine and a system for controlling or driving the fuel injection means. This makes it difficult to ensure required operational stability and driveability of the engine.

To avoid such disadvantage, it has been proposed by U.S. Ser. No. 376,106 assigned to the assignee of the present application to calculate and store as a second coefficient a mean value of values of a first coefficient applied during the air-fuel ratio feedback control responsive to detected values of the exhaust gas concentration, and apply the second coefficient or the mean value during subsequent open loop control, thus controlling the air-fuel ratio to values closer to the predetermined values appropriate to the respective particular operating conditions of the engine during the open loop control.

However, if the stored value of the second coefficient is erased upon interruption of the operation of the engine, the second coefficient applied after the restart of the engine will not have an appropriate value until after the feedback control has been carried out for a substantial period of time. As a consequence, the engine suffers from low operational stability and degraded driveability before the lapse of the above substantial period of time.

SUMMARY OF THE INVENTION

It is the object of the invention to provide an air-fuel ratio feedback control system for use with an internal combustion engine, which includes storage means for storing and holding the value of the second coefficient even during interruption of the operation of the engine, to thereby achieve proper air-fuel ratios immediately upon the subsequent start of the engine.

The present invention provides an air-fuel ratio feedback control system for controlling the air-fuel ratio of an air-fuel mixture being supplied to an internal combustion engine by the use of at least one coefficient, which comprises: a sensor arranged in the exhaust system of the engine, for detecting the concentration of exhaust gases from the engine; means for detecting a plurality of particular operating conditions of the engine; means responsive to an output of the particular operating condition detecting means indicative of an operating condition other than these particular operating conditions, for generating a first coefficient forming one of the above at least one coefficient and variable in response to the output of the exhaust gas concentration sensor; means for calculating a mean value of values of the first coefficient obtained in the above operating condition other than the particular operating conditions; means responsive to an output of the particular operating condition detecting means indicative of one of the particular operating conditions, for replacing the first coefficient by the mean value of the first coefficient from the calculating means as a second coefficient; and storage means for storing and holding the second coefficient both during operation of the engine and during stoppage of same.

Preferably, the above storage means is formed of a non-volatile memory.

The above and other objects, features and advantages of the invention will be more apparent from the ensuing detailed description taken in connection with the accompanying drawings.

BRIEF DESCRIPTION OF THE DRAWINGS

FIG. 9, 9A and 9B are a circuit diagram illustrating, by way of example, the whole internal arrangement of the ECU, showing in detail a correction coefficient $KO_2$ and KREF calculating section as well as a correction coefficient KREF storing section; and FIG. 10 is a fragmentary circuit diagram illustrating a modification of the correction coefficient KREF storing section in FIG. 9.

DETAILED DESCRIPTION

Details of the air-fuel ratio feedback control system according to the invention will now be described with reference to the drawings.

Figure 1:
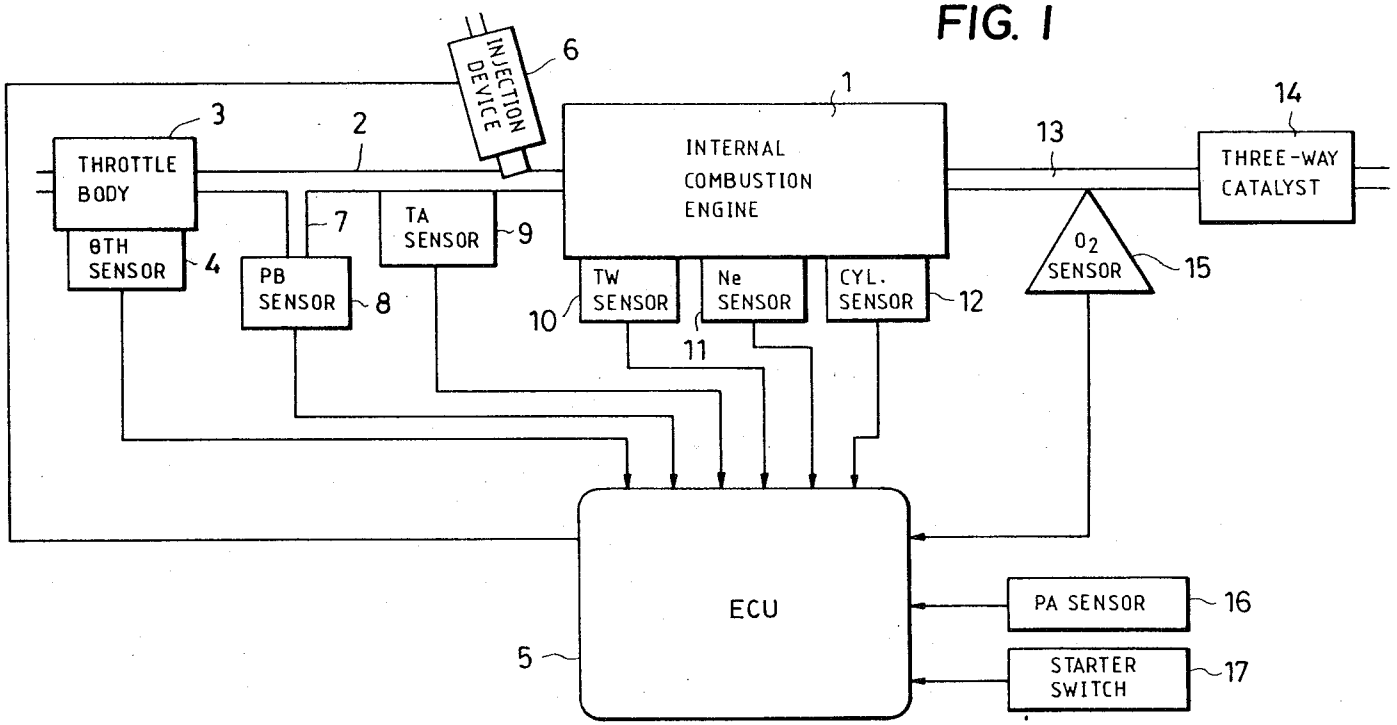
FIG. 1 is a block diagram illustrating the whole arrangement of an air-fuel ratio feedback control system according to the present invention.

Referring first to FIG. 1, there is illustrated the whole arrangement of a fuel supply control system for internal combustion engines, to which the present invention is applicable. Reference numeral 1 designates an internal combustion engine which may be a four-cylinder type, for instance. This engine 1 has main combustion chambers which may be four in number and sub combustion chambers communicating with the main combustion chambers, none of which is shown. An intake pipe 2 is connected to the engine 1, which comprises a main intake pipe communicating with each main combustion chamber, and a sub intake pipe communicating with each sub combustion chamber, neither of which is shown. Arranged across the intake pipe 2 is a throttle body 3 which accommodates a main throttle valve and a sub throttle valve mounted in the main intake pipe and the sub intake pipe, respectively, for synchronous operation. Neither of the two throttle valves is shown. A throttle valve opening sensor 4 is connected to the main throttle valve for detecting its valve opening and converting same into an electrical signal which is supplied to an electronic control unit (hereinafter called "ECU") 5.

A fuel injection device 6 is arranged in the intake pipe 2 at a location between the engine 1 and the throttle body 3, which comprises main injectors and a subinjector, none of which is shown. The main injectors correspond in number to the engine cylinders and are each arranged in the main intake pipe at a location slightly upstream of an intake valve, not shown, of a corresponding engine cylinder, while the subinjector, which is single in number, is arranged in the sub intake pipe at a location slightly downstream of the sub throttle valve, for supplying fuel to all the engine cylinders. The main injectors and the subinjecor are electrically connected to the ECU 5 in a manner having their valve opening periods or fuel injection quantities controlled by signals supplied from the ECU 5.

On the other hand, an absolute pressure sensor 8 communicates through a conduit 7 with the interior of the main intake pipe of the throttle body 3 at a location immediately downstream of the main throttle valve. The absolute pressure sensor 8 is adapted to detect absolute pressure in the intake pipe 2 and applies an electrical signal indicative of detected absolute pressure to the ECU 5. An intake-air temperature sensor 9 is arranged in the intake pipe 2 at a location downstream of the absolute pressure sensor 8 and also electrically connected to the ECU 5 for supplying thereto an electrical signal indicative of detected intake-air temperature.

An engine temperature sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rpm sensor (hereinafter called "Ne sensor") 11 and a cylinder-discriminating sensor 12 are arranged in facing relation to a camshaft, not shown, of the engine 1 or a crankshaft of same, not shown. The former 11 is adapted to generate one pulse at a particular crank angle each time the engine crankshaft rotates through 180 degrees, i.e., upon generation of each pulse of the top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure and a starter switch 17 for actuating the starter, not shown, of the engine 1, respectively, for supplying an electrical signal indicative of detected atmospheric pressure and an electrical signal indicative of its own on and off positions to the ECU 5.

Next, the fuel quantity control operation of the air-fuel ratio feedback control system of the invention outlined as above will now be described in detail with reference to FIG. 1 referred to hereinabove and FIGS. 2 through 9.

Figure 2:
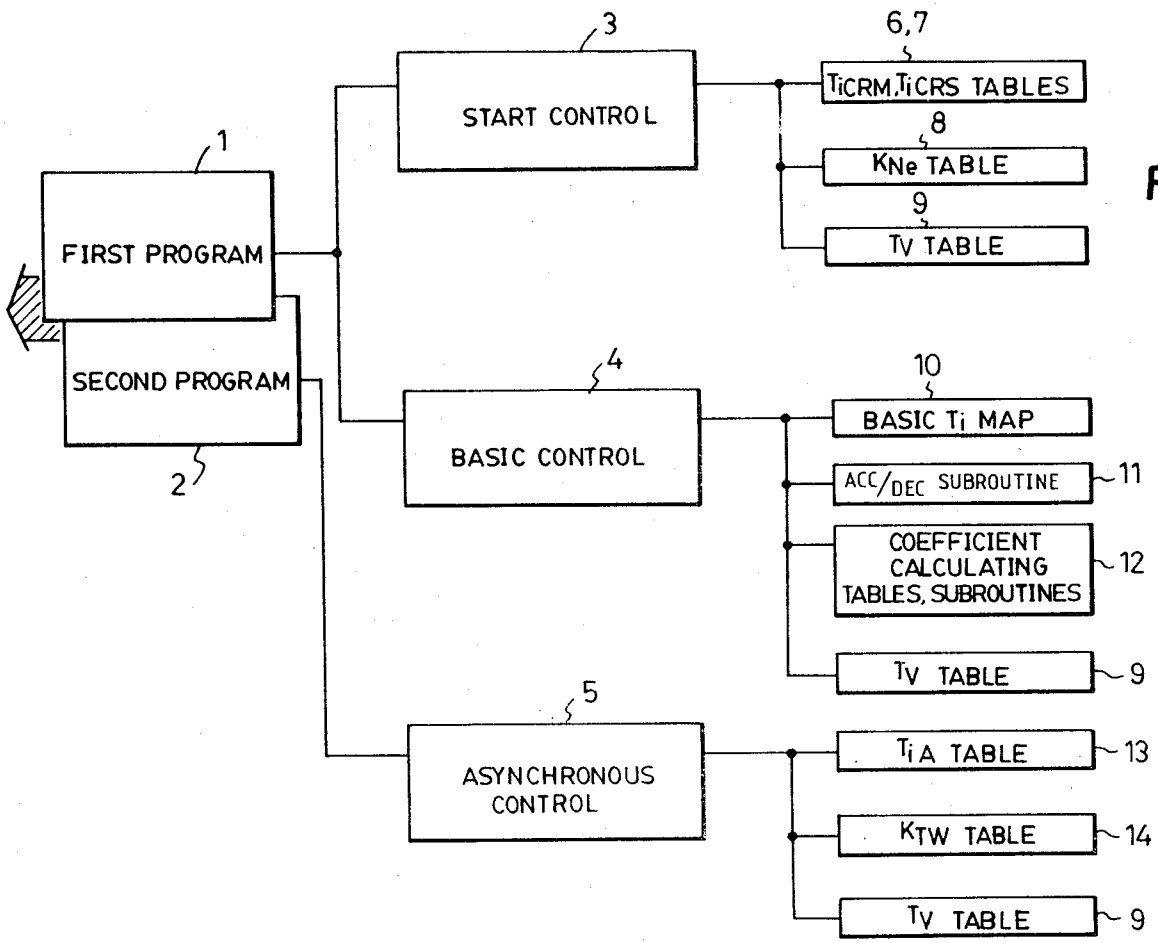
FIG. 2 is a block diagram illustrating a program for control of the valve opening periods TOUTM, TOUTS of the main injectors and the subinjector, which are operated by an electronic control unit (ECU) in FIG. 1.

Referring first to FIG. 2, there is illustrated a block diagram showing the whole program for air-fuel ratio control, i.e. control of valve opening periods TOUTM, TOUTS of the main injectors and the subinjector, which is executed by the ECU 5. The program comprises a first program 1 and a second program 2. The first program 1 is used for fuel quantity control in synchronism with the TDC signal, hereinafter merely called "synchronous control" unless otherwise specified, and comprises a start control subroutine 3 and a basic control subroutine 4, while the second program 2 comprises an asynchronous control subroutine 5 which is carried out in asynchronism with or independently of the TDC signal.

In the start control subroutine 3, the valve opening periods TOUTM and TOUTS are determined by the following basic equations:

$$TOUTM = TiCRM \times KNe + (TV + \Delta TV) \quad (1)$$

$$TOUTS = TiCRS \times KNe + TV \quad (2)$$

where TiCRM, TiCRS represent basic values of the valve opening periods for the main injectors and the subinjector, respectively, which are determined from a TiCRM table 6 and a TiCRS table 7, respectively, KNe represents a correction coefficient applicable at the start of the engine, which is variable as a function of engine rpm Ne and determined from a KNe table 8, and TV represent a constant for increasing and decreasing the valve opening period in response to changes in the output voltage of the battery, which is determined from a TV table 9. ΔTV is added to TV applicable to the main injectors as distinct from TV applicable to the subinjector, because the main injectors are structurally different from the subinjector and therefore have different operating characteristics.

The basic equations for determining the values of TOUTM and TOUTS applicable to the basic control subroutine 4 are as follows:

$$TOUTM = (TiM - TDEC) \times (KTA \times KTW \times KAFC \times KPA \times KAST \times KWOT \times KO_2 \times KLS) + TACC \times (KTA \times KTWT \times KAFC) + (TV + \Delta TV) \quad (3)$$

$$TOUTS = (TiS - TDEC) \times (KTA \times KTW \times KAST \times KPA) + TV \quad (4)$$

where TiM, TiS represent basic values of the valve opening periods for the main injectors and the subinjector, respectively, and are determined from a basic Ti map 10, and TDEC, TACC represent constants, applicable, respectively, at engine deceleration and at engine acceleration and are determined by acceleration and deceleration subroutines 11. The coefficients KTA, KTW, etc. are determined by their respective tables and/or subroutines 12. KTA is an intake air temperature-dependent correction coefficient and is determined from a table as a function of actual intake air temperature, KTW a fuel increasing coefficient which is determined from a table as a function of actual engine cooling water temperature TW, KAFC a fuel increasing coefficient applicable after fuel cut operation and determined by a subroutine, KPA an atmospheric pressure-dependent correction coefficient determined from a table as a function of actual atmospheric pressure, and KAST a fuel increasing coefficient applicable after the start of the engine and determined by a subroutine. KWOT is a coefficient for enriching the air-fuel mixture, which is applicable at wide-open-throttle and has a constant value, $KO_2$ an "$O_2$ feedback control" correction coefficient determined by a subroutine as a function of actual oxygen concentration in the exhaust gases, and KLS a mixture-leaning coefficient applicable at "lean stoich." operation and having a constant value. The term "stoich." is an abbreviation of a word "stoichiometric" and means a stoichiometric or theoretical air-fuel ratio of the mixture.

On the other hand, the valve opening period TMA for the main injectors which is applicable in asynchronism with the TDC signal is determined by the following equation:

$$TMA = TiA \times KTWT \times KAST + (TV + \Delta TV) \quad (5)$$

where TiA represents a TDC signal-asynchronous fuel increasing basic value applicable at engine acceleration and in asynchronism with the TDC signal. This TiA value is determined from a TiA table 13. KTWT is defined as a fuel increasing coefficient applicable at and after TDC signal-synchronous acceleration control as well as at TDC signal-asynchronous acceleration control, and is calculated from a value of the aforementioned water temperature-dependent fuel increasing coefficient KTW obtained from the table 14.

Figure 3:
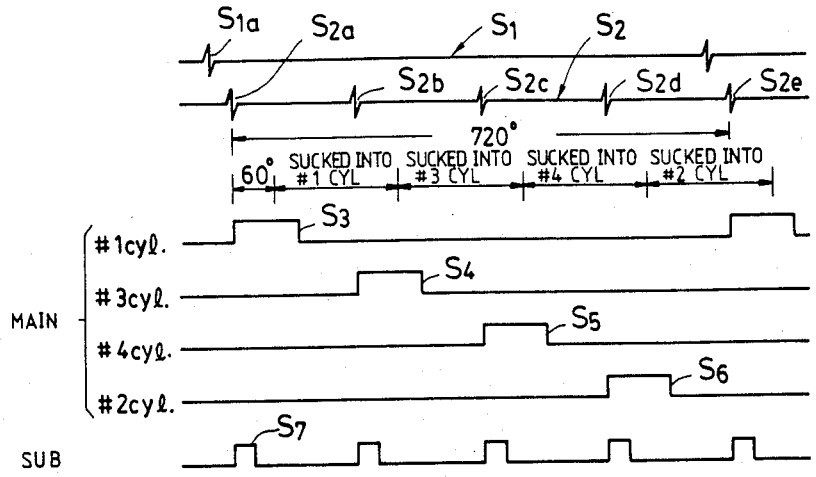
FIG. 3 is a timing chart showing the relationship between a cylinder-discriminating signal and a TDC signal inputted to the ECU, and drive signals for the main injectors and the subinjector, outputted from the ECU.

FIG. 3 is a timing chart showing the relationship between the cylinder-discriminating signal and the TDC signal, both inputted to the ECU 5, and the driving signals outputted from the ECU 5 for driving the main injectors and the subinjector. The cylinder-discriminating signal $S_1$ is inputted to the ECU 5 in the form of a pulse $S_1a$ each time the engine crankshaft rotates through 720 degrees. Pulses $S_2a$–$S_2e$ forming the TDC signal S2 are each inputted to the ECU 5 each time the engine crankshaft rotates through 180 degrees. The relationship in timing between the two signals $S_1$, $S_2$ determines the output timing of driving signals $S_3$–$S_6$ for driving the main injectors of the four engine cylinders. More specifically, the driving signal $S_3$ is outputted for driving the main injector of the first engine cylinder, concurrently with the first TDC signal pulse $S_2a$, the driving signal $S_4$ for the third engine cylinder concurrently with the second TDC signal pulse $S_2b$, the driving signal $S_5$ for the fourth cylinder concurrently with the third pulse $S_2c$, and the driving signal $S_6$ for the second cylinder concurrently with the fourth pulse $S_2d$, respectively. The subinjector driving signal $S_7$ is generated in the form of a pulse upon application of each pulse of the TDC signal to the ECU 5, that is, each time the crankshaft rotates through 180 degrees. It is also arranged that the pulses $S_2a$, $S_2b$, etc. of the TDC signal are each generated earlier by 60 degrees than the time when the piston in an associated engine cylinder reaches its top dead center, so as to compensate for arithmetic operation lag in the ECU 5, and a time lag between the formation of a mixture and the suction of the mixture into the engine cylinder, which depends upon the opening action of the intake pipe before the piston reaches its top dead center and the operation of the associated injector.

Figure 4:
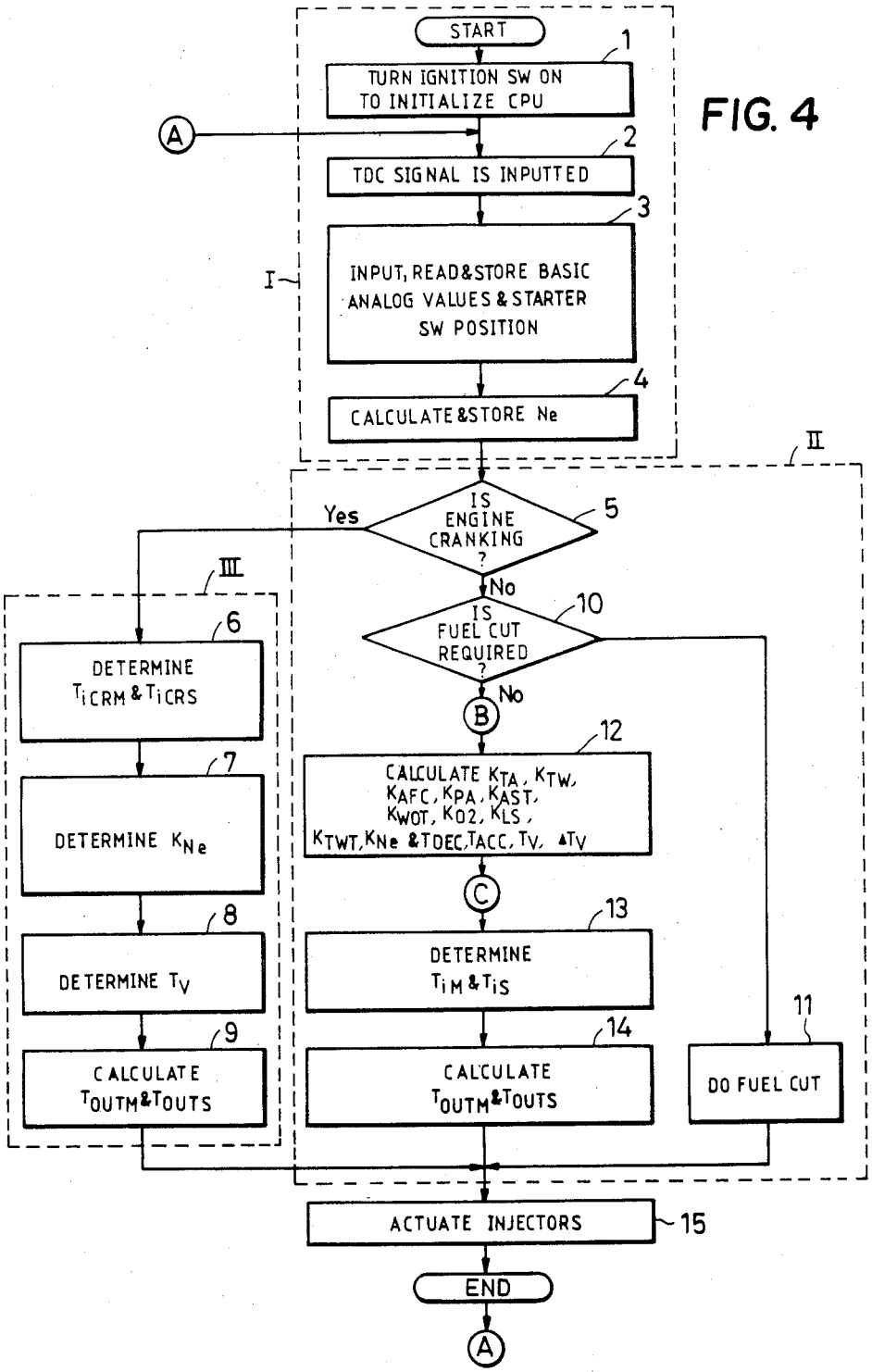
FIG. 4 is a flow chart showing a main program for control of the basic valve opening periods TOUTM, TOUTS.

Referring next to FIG. 4, there is shown a flow chart of the aforementioned first program 1 for control of the valve opening period in synchronism with the TDC signal in the ECU 5. The whole program comprises an input signal processing block I, a basic control block II and a start control block III. First in the input signal processing block I, when the ignition switch of the engine is turned on, CPU in the ECU 5 is initialized at the step 1 and the TDC signal is inputted to the ECU 5 as the engine starts at the step 2. Then, all basic analog values are inputted to the ECU 5, which include detected values of atmospheric pressure PA, absolute pressure PB, engine cooling water temperature TW, atmospheric air temperature TA, throttle valve opening θth, battery voltage V, output voltage value V of the $O_2$ sensor and on-off state of the starter switch 17, some necessary ones of which are then stored therein (step 3). Further, the period between a pulse of the TDC signal and the next pulse of same is counted to calculate actual engine rpm Ne on the basis of the counted value, and the calculated value is stored in the ECU 5 (step 4). The program then proceeds to the basic control block II. In this block, a determination is made, using the calculated Ne value, as to whether or not the engine rpm is smaller than the cranking rpm (starting rpm) at the step 5. If the answer is affirmative, the program proceeds to the start control subroutine III. In this block, values of TiCRM and TiCRS are selected from a TiCRM table and a TiCRS table, respectively, on the basis of the detected value of engine cooling water temperature TW (step 6). Also, the value of Ne-dependent correction coefficient KNe is determined by using the KNe table (step 7). Further, the value of battery voltage-dependent correction constant TV is determined by using the TV table (step 8). These determined values are applied to the aforementioned equations (1), (2) to calculate the values of TOUTM, TOUTS (step 9).

If the answer to the question of the above step 5 is no, it is determined whether or not the engine is in a condition for carrying out fuel cut, at the step 10. If the answer is yes, the values of TOUTM and TOUTS are both set to zero, at the step 11.

On the other hand, if the answer to the question of the step 10 is negative, calculations are carried out of values of correction coefficients KTA, KTW, KAFC, KPA, KAST, KWOT, $KO_2$, KLS, KTWT, etc. and values of correction constants TDEC, TACC, TV, and ΔTV, by means of the respective calculation subroutines and tables, at the step 12.

Then, basic valve opening period values TiM and TiS are selected from respective maps of the TiM value and the TiS value, which correspond to data of actual engine rpm Ne and actual absolute pressure PB and/or like parameters, at the step 13.

Then, calculations are carried out of the values TOUTM, TOUTS on the basis of the values of correction coefficients and correction constants selected at the steps 12 and 13, as described above, using the aforementioned equations (3), (4) (the step 14). The main injectors and the subinjector are actuated with valve opening periods corresponding to the values of TOUTM, TOUTS obtained by the aforementioned steps 9, 11 and 14 (the step 15).

As previously stated, in addition to the above-described control of the valve opening periods of the main injectors and the subinjector in synchronism with the TDC signal, asynchronous control of the valve opening periods of the main injectors is carried out in a manner asynchronous with the TDC signal but synchronous with a certain pulse signal having a constant pulse repetition period, detailed description of which is omitted here.

Figures 5, 5B:
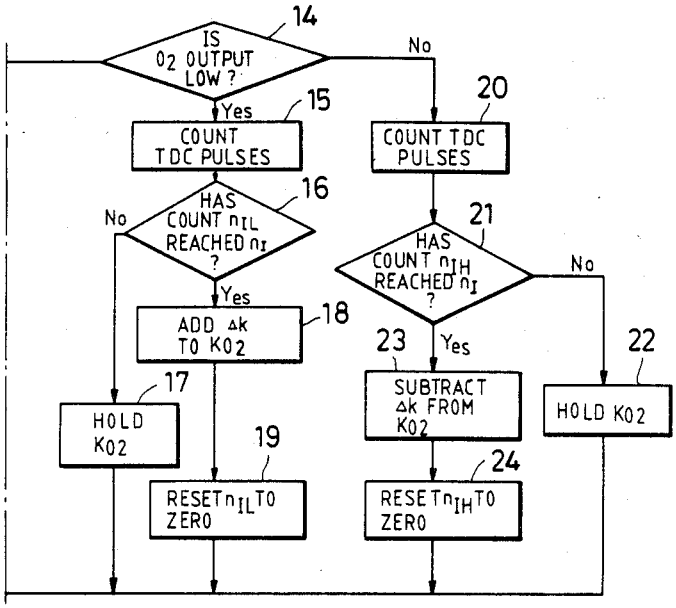
FIG. 5, 5A and 5B are a flow chart showing a subroutine for calculation of the value of "$O_2$-feedback control" correction coefficient $KO_2$.
Figure 5A:
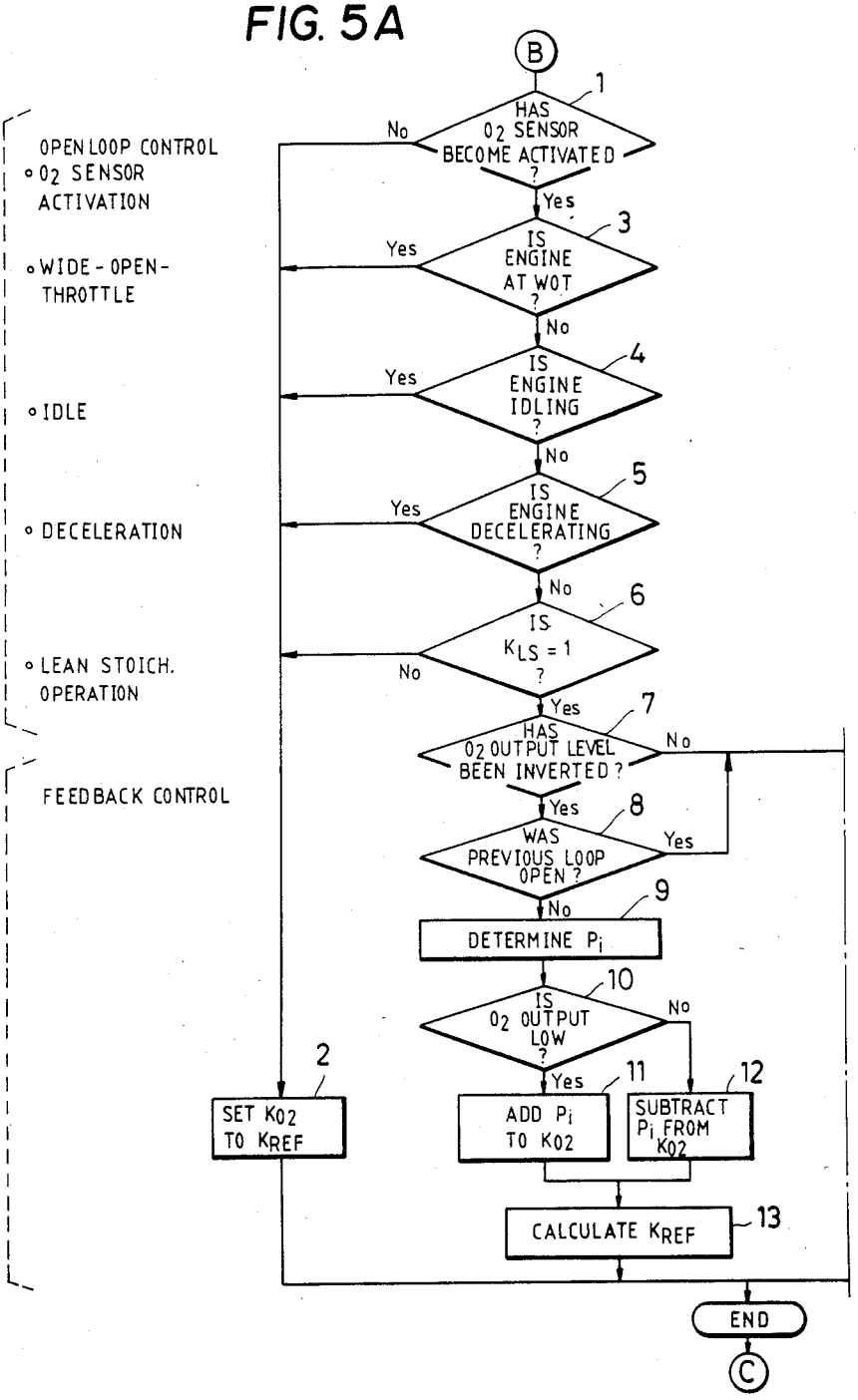

The subroutine for calculating the value of "$O_2$ feedback control" correction coefficient $KO_2$ will now be described with reference to FIG. 5 showing a flow chart of the same subroutine.

First, a determination is made as to whether or not the $O_2$ sensor has become activated, at the step 1. More specifically, by utilizing the internal resistance of the $O_2$ sensor, it is detected whether or not the output voltage of the $O_2$ sensor has dropped to an initial activation point VX (e.g. 0.6 volt). Upon the point VX being reached, an activation-indicative signal is generated which actuates an associated activation delay timer to start counting a predetermined period of time (e.g. 60 seconds). At the same time, it is determined whether or not both the water temperature-dependent fuel increasing coefficient KTW and the after-start fuel increasing coefficient KAST are equal to 1. If all the above conditions are found to be fulfilled, it is then determined that the $O_2$ sensor has been activated. If the activation of the $O_2$ sensor is negated at the step 1, the value of correction coefficient $KO_2$ is set to a mean value KREF, referred to later, which has been obtained in the last feedback control operation based on the $O_2$ sensor output, at the step 2. When the $O_2$ sensor is found to be activated, a determination is made as to whether or not the throttle valve is fully opened (wide-open-throttle), at the step 3. If the answer is yes, the value of $KO_2$ is also set to the above mean value KEF at the step 2. If the throttle valve is not fully opened, whether or not the engine is at idle is determined at the step 4. To be specific, if the engine rpm Ne is smaller than a predetermined value NLDL (e.g. 1000 rpm) and the absolute pressure PB is lower than a predetermined value PBIDL (e.g. 360 mmHg), the engine is judged to be idling, and then the above step 2 is executed to set the $KO_2$ value to the value KREF. If the engine is not found to be idling, whether or not the engine is decelerating is determined at the step 5. To be specific, it is judged that the engine is decelerating when the absolute pressure PB is lower than a predetermined value PBDEC (e.g. 200 mmHg), and then the value of $KO_2$ is held at the above value KREF, at the step 2. On the other hand, if it is determined that the engine is not decelerating, whether or not the mixture leaning coefficient KLS applicable at lean stoich. operation then has a value of 1 is determined at the step 6. If the answer is no, the $KO_2$ value is also held at the above value KREF at the step 2, while if the answer is yes, the program proceeds to the closed loop control which will be described below.

Figure 6:
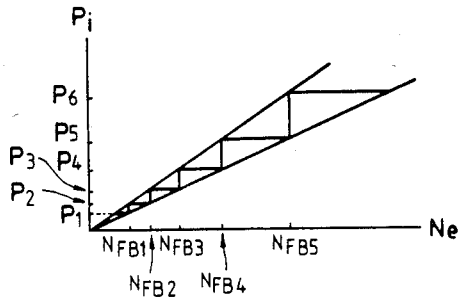
FIG. 6 is a view showing an Ne-Pi table for determining a correction value Pi for correcting "$O_2$-feedback control" correction coefficient $KO_2$.

In the closed loop control, it is first determined whether or not there has occurred an inversion in the output level of the $O_2$ sensor, at the step 7. If the answer is affirmative, whether or not the previous loop was an open loop is determined at the step 8. If it has been determined that the previous loop was not an open loop, the air-fuel ratio of the mixture is controlled by proportional term control (P-term control). More specifically, referring to FIG. 6 showing an Ne - Pi table for determining a correction amount Pi by which the coefficient $KO_2$ is corrected, five different predetermined Ne values NFB1–5 are provided which has values falling within a range from 1500 rpm to 3500 rpm, while six different predetermined Pi values P1–6 are provided in relation to the above Ne values, by way of example. Thus, the value of correction amount Pi is determined from the engine rpm Ne at the step 9, which is added to or subtracted from the coefficient $KO_2$ upon each inversion of the output level of the $O_2$ sensor. Then, whether or not the output level of the $O_2$ sensor is low is determined at the step 10. If the answer is yes, the Pi value obtained from the table of FIG. 6 is added to the coefficient $KO_2$, at the step 11, while if the answer is no, the former is subtracted from the latter at the step 12. Then, a mean value KREF is calculated from the value of $KO_2$ thus obtained, at the step 13. Calculation of the mean value KREF can be made by the use of the following equation:

$$KREF = \frac{CREF}{A} \times KO_2p + \frac{A - CREF}{A} \times KREF \qquad (6)$$

where $KO_2p$ represents a value of $KO_2$ obtained immediately before or immediately after a proportional term (P-term) control action, A a constant (e.g. 256), CREF a variable which is set within a range from 1 to A, and KREF' a mean value of values $KO_2$ obtained from the start of the first operation of an associated control circuit to the last proportional term control action inclusive. The value KREF' is stored in a storage means without being erased even during stoppage of the operation of the engine so that it can be used immediately upon restarting of the engine.

Since the value of the variable CREF determines the ratio of the value $KO_2p$ obtained at each P-term control action to the value KREF, an optimum value KREF can be obtained by setting the value CREF to a suitable value within the range from 1 to A depending upon the specifications of an air-fuel ratio feedback control system, an engine, etc. to which the invention is applied.

Figure 7:
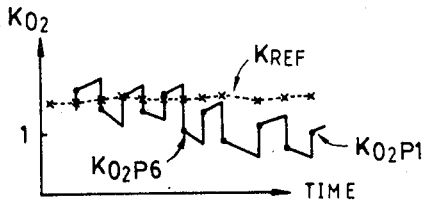
FIG. 7 is a graph showing a manner of detecting the value of correction coefficient $KO_2$ by means of proportional term control.

As noted above, the value KREF is calculated on the basis of a value $KO_2p$ obtained immediately before or immediately after each P-term control action. This is because an air-fuel ratio of the mixture being supplied to the engine occurring immediately before or immediately after a P-term control action, that is, at an instant of inversion of the output level of the $O_2$ sensor shows a value most close to the theoretical mixture ratio (14.7). Thus, a mean value of $KO_2$ values can be obtained which are each calculated at an instant when the actual air-fuel ratio of the mixture shows a value most close to the theoretical mixture ratio, thus making it possible to calculate a value KREF most appropriate to the actual operating condition of the engine. FIG. 7 is a graph showing a manner of detecting (calculating) the value $KO_2P$ at an instant immediately after each P-term control action. In FIG. 7, the mark indicates a value $KO_2p$ detected immediately after a P-term control action, and $KO_2p1$ is an up-to-date value detected at the present time, while $KO_2p6$ is a value detected immediately after a P-term control action which is a sixth action from the present time.

The mean value KREF can also be calculated from the following equation, in place of the aforementioned equation (6):

$$KREF = \frac{1}{B} \sum_{j=1}^{B} KO_2pj \tag{7}$$

where $KO_2pj$ represents a value of $KO_2p$ obtained immediately before or immediately after a jth P-term control action before the present one, and B a constant which is equal to a predetermined number of P-term control actions (a predetermined number of inversions of the $O_2$ sensor output) subjected to calculation of the mean value. The larger the value of B, the larger the ratio of each value $KO_2p$ value KREF. The value of B is set at a suitable value depending upon the specifications of an air-fuel ratio feedback control system, an engine, etc. to which the invention is applied. According to the equation (7), calculation is made of the sum of the values of $KO_2pj$ from the P-term control action taking place B times before the present P-term control action to the present P-term control action, each time a value of $KO_2pj$ is obtained, and the mean value of these values of $KO_2pj$ forming the sum is calculated.

Further, according to the above equations (6) and (7), the mean value KREF is renewed each time a new value of $KO_2p$ is obtained during feedback control based upon the $O_2$ sensor output, by applying the above new value of $KO_2p$ to the equations. Thus, the value KREF obtained always fully represents the actual operating condition of the engine.

Figure 8:
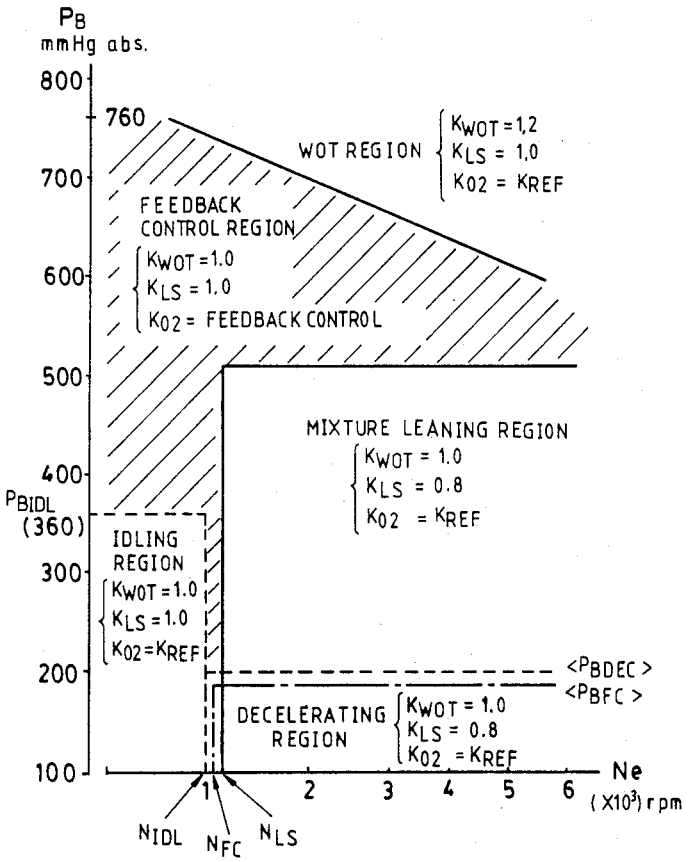
FIG. 8 is a graph showing a manner of applying correction coefficient to various operating conditions of the engine.

The mean value KREF of values of coefficient $KO_2$ at P-term control actions, calculated as described above, is stored in a storage means and used for control of the air-fuel ratio of the mixture together with the other correction coefficients, that is, the wide-open-throttle correction coefficient KWOT and the mixture-leaning operation correction coefficient KLS, during an open loop control operation immediately following the feedback control operation based upon the $O_2$ sensor output in which the same value KREF has been calculated. The open loop control operation is carried out in particular engine operating regions such as an engine idle region, a mixture leaning region, a wide-open-throttle operating region, and a decelerating region. More specifically, as shown in FIG. 8, in the wide-open-throttle operating region, the value of $KO_2$ is set to the mean value KREF obtained in the $O_2$ sensor output-based feedback control operation carried out immediately before the present time, and simultaneously the value of the wide-open-throttle coefficient KWOT is set to a predetermined value of 1.2, and the value of the mixture leaning coefficient KLS a value of 1.0, respectively. In the mixture leaning region and the decelerating region, the value of $KO_2$ is set to the above mean value KREF, the coefficient KLS a predetermined value of 0.8, and the coefficient KWOT a value of 1.0, respectively. In the idling region, the value of $KO_2$ is set the above value KREF, and the coefficients KLS, KWOT are both set to 1.0.

Reverting now to FIG. 5, if the answer to the question of the step 7 is no, that is, if the $O_2$ sensor output level remains at the same level, or if the answer to the question of the step 8 is yes, that is, if the previous loop was an open loop, the air-fuel ratio of the mixture is controlled by integral term control (I-term control). More specifically, whether or not the $O_2$ sensor output level is low is determined at the step 14. If the answer is yes, TDC signal pulses are counted at the step 15, accompanied by determining whether or not the count nIL has reached a predetermined value nI (e.g. 30 pulses), at the step 16. If the predetermined value nI has not yet been reached, the $KO_2$ value is held at its immediately preceding value, at the step 17. If the value nIL is found to have reached the value nI, a predetermined value $\Delta k$ (e.g. about 0.3% of the $KO_2$ value) is added to the $KO_2$ value, at the step 18. At the same time, the number of pulses nIL so far counted is resetted to zero at the step 19. After this, the predetermined value $\Delta k$ is added to the $KO_2$ value each time the value nIL reaches the value nI. On the other hand, if the answer to the question of the step 14 is found to be no, TDC pulses are counted at the step 20, accompanied by determining whether or not the count nIH has reached the predetermined value nI at the step 21. If the answer is no at the step 21, the $KO_2$ value is held at its immediately preceding value, at the step 22, while if the answer is yes, the predetermined value $\Delta k$ is subtracted from the $KO_2$ value, at the step 23, and simultaneously the number of pulses nIH so far counted is resetted to zero at the step 24. Then, the predetermined value $\Delta k$ reaches the value nI in the same manner as mentioned above.

Figure 9A:
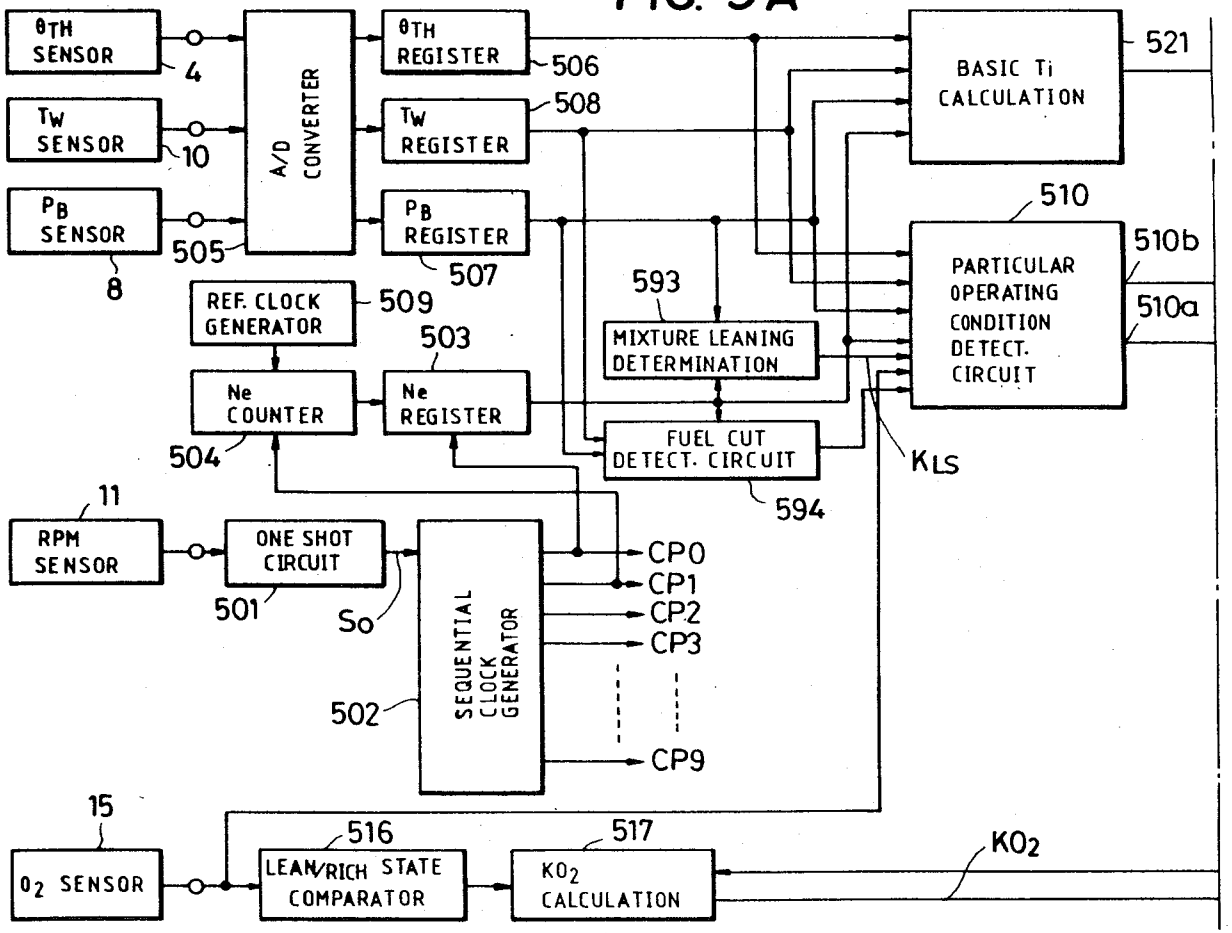

FIG. 9 is a circuit diagram illustrating the whole internal arrangement of the ECU 5 used in the air-fuel ratio feedback control system of the invention described above, in which the calculating sections for the correction coefficients $KO_2$ and KREF and the storage section for the coefficient KREF are shown in particular detail.

In FIG. 9, the TDC signal picked up by the engine rpm (Ne) sensor 11 appearing in FIG. 1 is applied to a one shot circuit 501 which forms a waveform shaper circuit in cooperation with a sequential clock generator circuit 502 arranged adjacent thereto. The one shot circuit 501 generates an output signal So upon application of each TDC signal pulse thereto, which signal actuates the sequential clock generator circuit 502 to generate clock pulses CP0 and 1 in a sequential manner. The clock pulse CP0 is supplied to an engine rpm (Ne) register 503 to cause same to store an immediately preceding count outputted from an engine rpm (Ne) counter 504 which counts reference clock pulses generated by a reference clock generator 509. The clock pulse CP1 is applied to the engine rpm counter 504 to reset the immediately preceding count in the counter 504 to zero. Therefore, the engine rpm Ne is measured in the form of the number of reference clock pulses counted between two adjacent pulses of the TDC signal, and the counted reference clock pulse number or measured engine rpm Ne is stored into the above engine rpm register 503.

In a manner parallel with the above operation, output signals of the throttle valve opening ($\theta$th) sensor 4, the absolute pressure (PB) sensor 8 and the engine water temperature (TW) sensor 10 are supplied to an A/D converter unit 505 to be converted into respective digital signals which are in turn applied to a throttle valve opening ($\theta$th) register 506, an absolute pressure (PB) register 507, and an engine water temperature (TW) register 508, respectively. The values stored in the above registers and the value stored in the engine rpm register 503 are supplied to a basic Ti calculating circuit 521 and a particular operating condition detecting circuit 510. The values stored in the absolute pressure register 507 and the engine rpm register 503 are also supplied to a mixture leaning operation-determining circuit 593 which in turn is responsive to these input values to supply a signal indicative of the value of correction coefficient KLS to the particular operating condition detecting circuit 510 during mixture leaning operation. Further, the values stored in the engine rpm register 503, the absolute pressure register 507 and the engine water temperature register 508 are also supplied to a fuel cut detecting circuit 594 which in turn is responsive to these input values to supply the particular operating condition detecting circuit 510 with a binary signal indicative of whether or not the engine is in a fuel-cut condition. The basic Ti calculating circuit 521 is responsive to the values inputted from the above registers 503, and 506–508 to carry out calculations of the values of the coefficients for determination of the basic fuel injection period Ti. The particular operating condition detecting circuit 510 is also supplied with an output signal from the $O_2$ sensor 15 in FIG. 1 and responsive to the value of the same output signal to determine whether or not the activation of the $O_2$ sensor 15 has been completed. After determining the completion of the activation of the $O_2$ sensor 15, the circuit 510 further determines whether or not the engine is operating in a particular operating region (for instance, wide-open-throttle operating region, idling region, decelerating region, or mixture leaning region). Upon fulfilment of one of the above particular operating conditions, the circuit 510 generates a binary output of 1 as an open loop command signal at its output terminal **510*b*. When none of the above particular operating conditions is fulfilled, that is, when the engine is operated in an air-fuel ratio feedback control mode in response to the $O_2$ sensor output, the circuit 510 generates a binary output of 1 as a closed loop command signal at its output terminal 510*a*. The former output of 1 generated at the output terminal 510*b* is supplied to one input terminal of an AND circuit 512, and the latter output of 1 at the output terminal 510*a* one input terminal of an AND circuit 511, respectively. The AND circuits 511 and 512 have their other input terminals supplied, respectively, with values stored in a first predetermined value memory 513 and a second predetermined value memory 514. The first predetermined value memory 513 stores coefficient values (e.g. a KWOT value of 1.0 and a KLS value of 1.0) applicable when none of the particular operating conditions is fulfilled, that is, during "$O_2$ feedback control" operation, and the second predetermined value memory 514 stores coefficient values (e.g. a KWOT value of 1.2 and a KLS value of 1.0 for wide-open-throttle operating region, a KWOT value of 1.0 and a KLS value of 0.8 for mixture leaning region, a KWOT of 1.0 and a KLS value of 0.8 for decelerating region, and a KWOT value of 1.0 and a KLS value of 1.0 for idling region) applicable when one of the particular operating conditions is filfilled, that is, during open loop control operation. As long as the AND circuits 511 and 512 are supplied at their above one input terminals with the outputs of 1 from the particular operating condition detecting circuit 510, they allow the values stored in the memories 513 and 514 to be supplied as second coefficients to a multiplier 524, hereinafter referred to, through an OR circuit 515**.

On the other hand, the output signal of the $O_2$ sensor 15 in FIG. 1 is inputted to a lean/rich state comparator 516 in FIG. 9, which in turn determines whether or not the output level of the $O_2$ sensor 15 is low or high. The resultant lean/rich state-discriminating signal is applied to a $KO_2$ calculating circuit 517 which is also supplied with the closed loop command signal from the output terminal **510*a* of the particular operating condition detecting circuit 510. The $KO_2$ calculating circuit 517 is responsive to the above lean/rich state-discriminating signal to calculate the value of $KO_2$, as described in detail later, and the resultant calculated value $KO_2$ is applied to one input terminal of an AND circuit 518. The AND circuit 518 is arranged to be supplied at its other input terminal with the closed loop command signal of 1 from the particular operating condition detecting circuit 510 through its output terminal 510*a*. Thus, during the $O_2$ feedback control when no particular operating condition is fulfilled, the AND circuit 518 allows the calculated $KO_2$ value signal supplied from the $KO_2$ calculating circuit 517 to be applied as a first coefficient b to one input terminal of a first multiplier 523 through an OR circuit 520. The first multiplier 523 has its other input terminal supplied with a basic value signal as input a from the basic Ti calculating circuit 521 to multiply this Ti value a by the above calculated $KO_2$ value b, and the resultant product signal $a \times b$ or $Ti \times KO_2$ is applied as input c to one input terminal of a second multiplier 524. This second multiplier 524 has its other input terminal supplied with the values of coefficients KWOT, KLS applicable during closed loop control (both having a value of 1.0) as input d, to multiply the above product $a \times b$ equalling $Ti \times KO_2$ by the values of coefficients KWOT, KLS to obtain a basic value TOUT' (which is substantially equal to the output product of the first multiplier 523). This basic value TOUT' is applied to a TOUT value control circuit 526 through a TOUT' value register 525. The TOUT value control circuit 526** performs an arithmetic operation using the aforementioned basic equation by adding to and/or multiplying the value TOUT' by the aforementioned other correction coefficients and constants, results of which are supplied to the main injectors as driving outputs.

During the above-described $O_2$ feedback control operation, the output of the AND circuit 518 is also supplied to a mean value calculating circuit 519 which in turn calculates a mean value KREF from $KO_2$ values successively inputted thereto during the $O_2$ feedback control operation, the resultant mean value KREF is applied to the input of a KREF value register 527 which is especially provided by the present invention.

The KREF value register 527 is connected to a power source 530 such as a battery, which is adapted to supply the KREF value register 527 with a constant voltage VA upon turning-on of the ignition switch 17 in FIG. 1. The register 527 is also connected to a back-up power source 528 by way of a diode 529. The back-up power source is adapted to supply the KREF value register 527 with required power when the ignition switch 17 is off or when the voltage VA from the battery 530 drops below an output voltage VB from the back-up power source 528. So long as the back-up power source 528 is operative to supply power, a KREF value remains stored in the KREF value register 527 without being erased, even when the engine is stopped by turning the ignition switch 17 off. The KREF value register 527 has its output connected to one input terminal of an AND circuit 522 to supply same with a KREF value stored therein.

When one of the particular operating conditions of the engine is detected by the detecting circuit 510, the AND circuit 522 has its other input terminal supplied with the open loop command signal of 1 from the circuit 510 so that the calculated mean value KREF supplied from the mean value calculating circuit 519 is applied to the first multiplier 523 as the first coefficient. The first multiplier 523 calculates a product of a basic value Ti and this calculated mean value KREF to apply the resultant signal to the second multiplier 524, in the same manner as previously described. During the open loop control operation, the second multiplier 524 is supplied with the values of coefficients KWOT, KLS as the second coefficients from the second predetermined value memory 514, through the AND circuit 512 and the OR circuit 515, to multiply a product value supplied from the first multiplier 523 by the values of these second coefficients. The resultant product signal is supplied to the TOUT value control circuit 526 through the TOUT' value register 525, and then the TOUT value control circuit 526 performs a valve opening period control operation similar to that performed during the closed loop control operation as previously described.

Although the aforementioned KREF value register 527 is arranged to be permanently supplied with electric power for permanent storage of a KREF value therein, various types of storage means may be used in place of the register 527, if only they can continuously store the KREF value even during stoppage of the engine. For instance, as shown in FIG. 10, a non-volatile random access memory (RAM) 527' may be used, to which the power source 530 alone is connected. The value stored in the RAM 527' will not be erased from the RAM even when the power supply is cut off by turning-off of the ignition switch, etc., dispensing with a back-up power source and reducing the burden on the power source battery.

What is claimed is:

1. An air-fuel ratio feedback control system for controlling the air-fuel ratio of an air-fuel mixture being supplied to an internal combustion engine having an exhaust system, comprising:

a sensor arranged in said exhaust system for detecting the concentration of exhaust gases emitted from said engine;

means for detecting a plurality of particular operating conditions of said engine;

means for detecting at least one engine operating parameter value;

means for calculating a basic value of the air-fuel ratio on the basis of at least one detected engine operating parameter value;

electric circuit means responsive to the output of said exhaust gas concentration sensor to generate (i) a first coefficient variable in response to the output of said exhaust gas concentration sensor and (ii) at least one second coefficient variable in response to the output of said particular operating condition detecting means, said first and second coefficients being applied for correction of said basic value, said electric circuit means including means operable when the engine is operating in an operating condition other than said particular operating conditions, to (i) vary the value of said first coefficient in response to the output of said exhaust gas concentration sensor and (ii) simultaneously hold the value of said second coefficient at a first predetermined value which does not substantially change said basic value of the air-fuel ratio;

means for calculating as a second predetermined value a mean value of values of said first coefficient obtained when the engine is operating in said operating condition other than said particular operating conditions;

means operable when the engine is operating in one of said particular operating conditions, to (i) hold the value of said second coefficient at a third predetermined value different from said first predetermined value but appropriate to said one of said particular operating conditions and (ii) simultaneously hold the value of said first coefficient at said second predetermined value, whereby the air-fuel ratio is close to a desired air-fuel ratio suitable for operation of the engine in each of said particular operating conditions; and storage means for storing and holding said second predetermined value both during operation of the engine and during stoppage of the engine.

2. An air-fuel ratio feedback control system as claimed in claim 1, wherein said storage means comprises a register for storing said second predetermined value first and second power sources for supplying power to said register, and means for causing one of said first and second power sources to supply power to said register when the other of said first and second power sources fails to supply power to said register.

3. An air-fuel ratio feedback control system as claimed in claim 1, wherein said storage means comprises a non-volatile memory, and a power source for supplying power to said memory.

* * * * *